United States Patent [19]

Bialobrzeski

[11] 4,153,172

[45] May 8, 1979

[54] CONTAINER SAFETY CLOSURE

[76] Inventor: Walter Bialobrzeski, 68 Summerwood Rd., Wallingford, Conn. 06492

[21] Appl. No.: 902,240

[22] Filed: May 2, 1978

Related U.S. Application Data

[63] Continuation-in-part of Ser. No. 387,948, Aug. 13, 1973, abandoned.

[51] Int. Cl.[2] ..... B65D 55/02; B65D 85/56; A61J 1/00

[52] U.S. Cl. ..... 215/209; 215/222; 220/85 SP

[58] Field of Search ..... 215/209, 221, 222, 301; 220/85 SP

[56] References Cited

U.S. PATENT DOCUMENTS

| | | | |
|---|---|---|---|
| 3,623,623 | 11/1971 | Bauer | 215/222 X |
| 3,968,871 | 7/1976 | Briscoe | 215/221 X |
| 3,974,928 | 8/1976 | Domaracki et al. | 215/222 X |

*Primary Examiner*—George T. Hall
*Attorney, Agent, or Firm*—DeLio and Montgomery

[57] ABSTRACT

A container safety closure including a spring element in the form of a generally convoluted tubular plastic element preset to a stable condition, where its further compression response is determined by special tapering of the wall thickness and radii of the convolutions. The spring element biases a container closure member against a detent arrangement and the spring must be compressed to permit the closure member to be removed from the container.

7 Claims, 18 Drawing Figures

CONTAINER SAFETY CLOSURE

This application is a continuation-in-part of co-pending application Ser. No. 387,948, filed Aug. 13, 1973, now abandoned.

This invention relates to a spring biased safety closure for a container.

A vital part of many safety closures is a resilient (spring) element against which force must be applied to place the closure in position to be further manipulated, for closing or opening. Thus, resilient elements of various types are shown in the following patents: Allan, U.S. Pat. No. 2,816,677; Towns, U.S. Pat. No. 2,964,207; Hedgewick, U.S. Pat. No. 3,344,942 and U.S. Pat. No. 3,485,403; Fitzgerald, U.S. Pat. No. 3,608,762. None of these resilient elements, however, has the special characterics of the springs disclosed herein.

According to the present invention, a container with a safety closure cap includes a spring element in the form of a molded plastic circularly (or helically) convoluted tube in which the wall thickness is specially tapered to control the compressability of the spring in a predetermined range of operation, the spring being preset by compression to a stabilized length dimension, shorter than its original length, its residual resistance to compression being substantial, relatively constant and not subject to further permanent alteration in its range of operation.

Several forms of the invention are shown herein, embodied in a variety of closures for containers, particularly "safety caps" which are relatively easy for adults to use, but which require an effort of such a nature that a child will not readily learn the manner of operation by either observation or experimentation.

The spring element can be blow-molded integrally with the neck of a plastic bottle, or injection molded separately or integrally with a one-piece closure or with one part of a two or more part closure. While a generally tubular form is requisite, the shape may be cylindrical, frusto-conic, square, rectangular, or other desired configuration.

An object of this invention is to provide a new and improved container safety closure.

Another object of this invention is to povide a new and improved spring element for a container safety closure.

The features of the invention which are believed to be novel are particularly pointed out and distinctly claimed in the concluding portion of this specification. The invention, however, both as to its organization and operation together with further objects and advantages thereof may best be appreciated by reference to the following detailed description taken in conjunction with the drawings, wherein:

Figure 2:
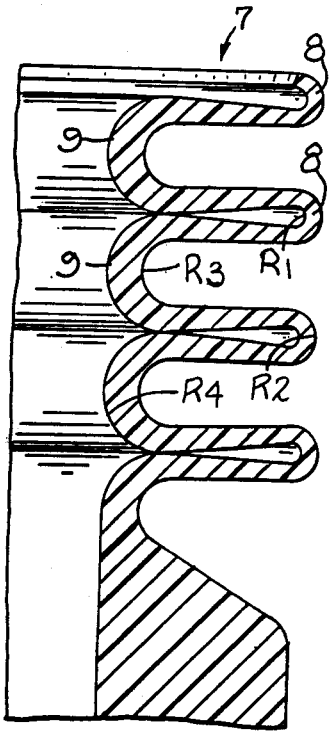
Figure 3:
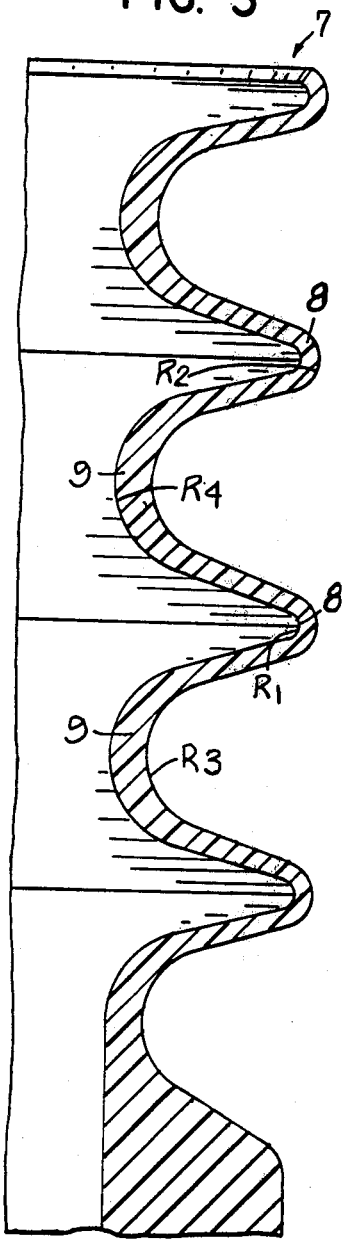

A spring 7 embodying the invention has outer convolutions 8 of a thickness defined by the radii $R_1$ and $R_2$, and inner convolutions 9 defined by radii $R_3$ and $R_4$. The walls of the spring are of tapering thickness between the inner and outer convolutions. The radii $R_1$ and $R_2$, and $R_3$ and $R_4$ determine the convolution thickness, and this together with other dimensioning of the spring and the material determine the spring rate. After forming of the spring element 7, it is initially compressed until it bottoms or essentially bottoms, as shown in FIG. 2. Upon release of the initial set, the spring returns to a stable length which may be ten to forty percent shorter than the original length. As originally formed, the spring is rather stiff, but upon the initial compression becomes more resilient.

During the initial compression, most of the set takes place in the thinner convolutions 8, although some of the set does take place in the thicker walled convolutions.

At the present time, a preferred plastic is acetal. Other materials useful in the manufacture of spring elements embodying the invention include polyethylene, polypropylene, polyurethane, tetrafluoroethylene, nylon, and flexible PVC. The parameters of the spring and the spring rate will depend upon the thickness of the convolutions defined by the radii $R_1$ and $R_2$, and $R_3$ and $R_4$, the material of the spring, and the relative diametric and axial dimensioning of the convolutions.

A uniformly thin walled spring would tend to take a greater permanent set and would not adequately resist compression. A uniformly thick walled spring would tend to be too stiff throughout its compression range.

The spring is preferably formed by molding either injection or blow molding, as described in co-pending application Ser. No. 902,257 filed on the same date as this application. The spring per se is disclosed and claimed in application Ser. No. 902,256, filed on the same date as this application. As hereinafter described, a safety closure system embodying the invention may be made either as a separate spring element or as part of a container or closure therefor.

Figure 4:
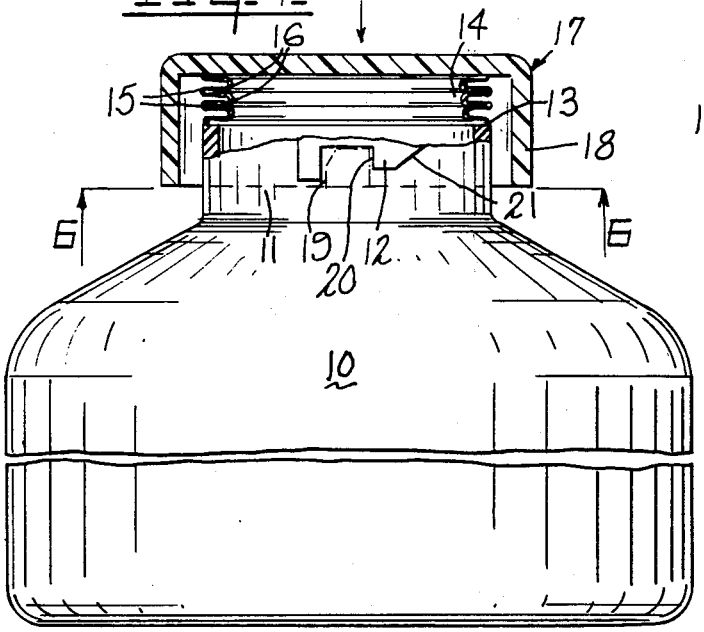
FIG. 4 represents an elevation, partly in vertical section, of a container with spring and cap in closed position, parts being broken away.
Figure 5:
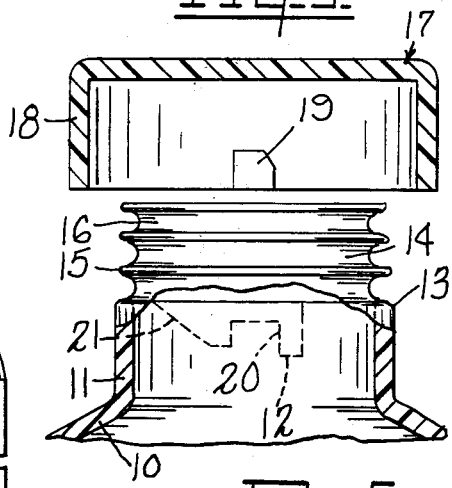
FIG. 5 represents a detail vertical section of the container neck, spring and cap of FIG. 1, with the cap separated.
Figure 6:
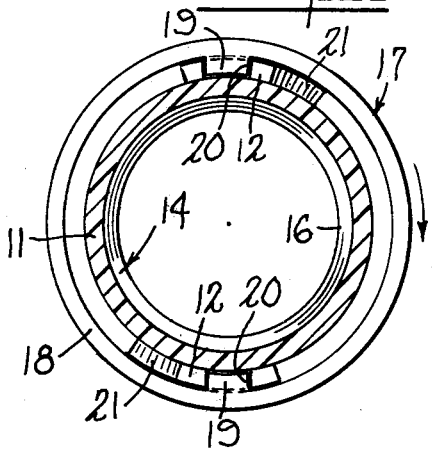
FIG. 6 represents a horizontal section on the line 6—6 of FIG. 4.

The container of FIGS. 4, 5 and 6 is of molded plastic having a body 10 and neck 11, the neck being cylindrical with oppositely disposed latches 12 projecting from its outer surface, adjacent the lip 13. A spring 14, according to the invention, is integral with or cemented to the lip of the neck, the spring being generally cylindrical and annularly convoluted, and the wall of the spring being preferably thinner in the zones of the outer folds 15 and thicker in the zones of the inner folds 16. When a plastic spring having these relative wall dimensions is strongly compressed (as explained above) its convolutions take a permanent set, reducing the axial dimension, for instance, to about 75% of the initial molded length, the deformation being most noticeable in the thin walled outer folds, as indicated in FIG. 5. This container is closed by a cap 17 having a cylindrical skirt portion 18 which bears oppositely disposed inwardly projecting lugs 19, each of a size to fit snugly in the square-sided recess 20 of a corresponding latch 12.

Figure 1:
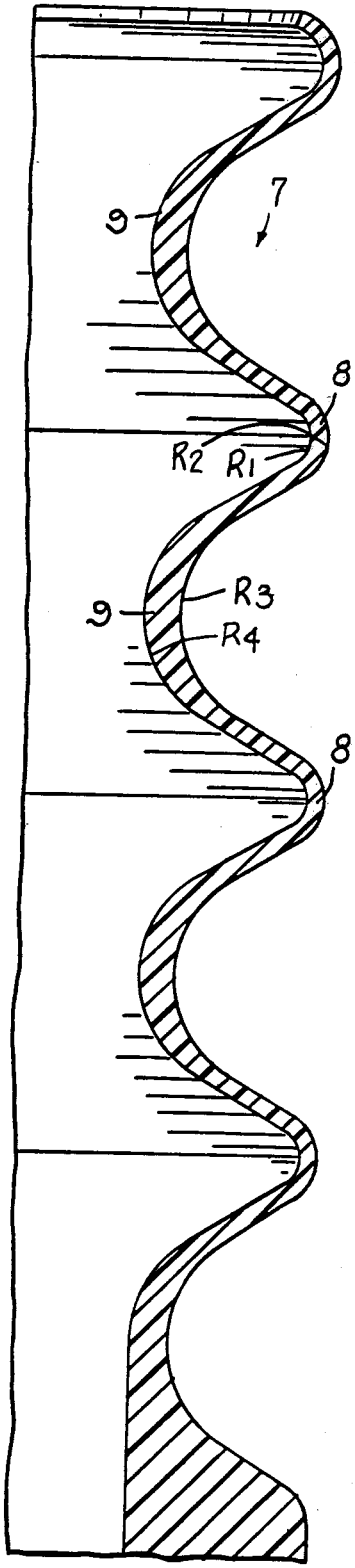
FIGS. 1-3 represent, on an enlarged scale, certain details of the formation of springs, according to the invention.

The dimensions of the parts are such that the cap must be pressed downward against the spring 14, compressing it close to its limit of compression, followed by rotation of the cap, in order to move the lugs 19 up the ramps 21 of the latches and on into engagement with the recesses 20, as shown in FIG. 1. In this locked position the outer (thinner) folds 15 of the spring are closed or substantially closed and any further compression (to release the lugs 19 from the recesses 20) must be exerted mostly against the stronger resistance of the inner (thicker) folds 16, as they approach their limit of compression. This requirement for greatly increased force constitutes an important safety factor, e.g., against unauthorized opening of the container by a child.

Figure 7:
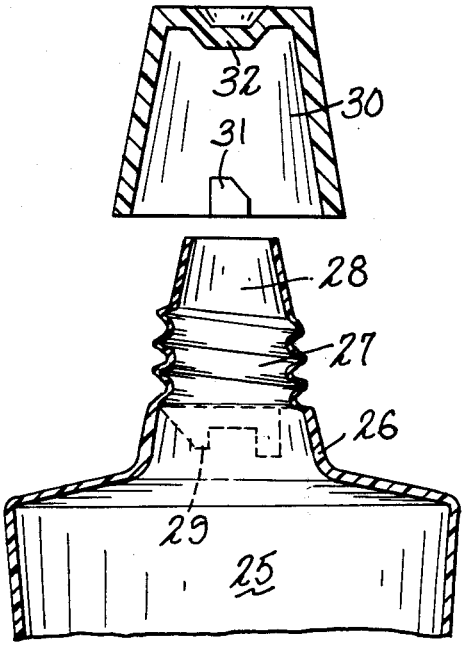
FIG. 7 represents a detail vertical section of a modified form of container top and cap, separated.

In the modified form of container 25 shown in FIG. 7, the neck 26, spring 27 and neck extension 28 are all integral with the container body and the spring is formed as a frustoconic helix. The wall of the spring is varied in thickness as described above and it is preset by compression to a stable axial dimension. Latches 29, like the latches 12 in FIGS. 4–6, are formed on the outer surface of the neck 26 and the frustoconic cap 30 has lugs 31 adjacent its lower edge for engagement with the latches when the cap is applied with sufficient downward pressure to collapse the spring toward its maximum compressed position, the lugs being engaged with or disengaged from the latches as described above. The cap 30 may be formed with a tapered inward projection 32 for tight sealing engagement with the lip of the extension 28.

Figure 8:
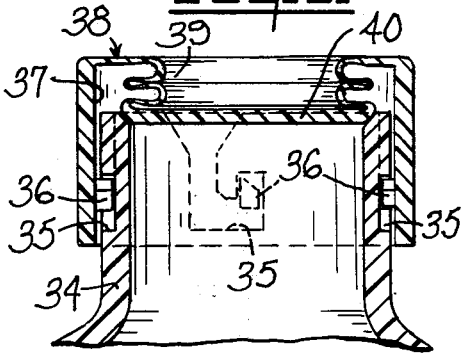
FIG. 8 represents a detail vertical section of another modified form of container neck and cap, in closed position.

FIG. 8 shows a closure system in which the bottle neck 34 is formed with external bayonet grooves 35 to receive lugs 36 on the inner side walls 37 of a cap 38. The spring 39 is an integral part of the cap and is also integral with the sealing disc 40. The spring has convolutions with thin outer folds and thicker inner folds, as before, and it is so dimensioned that the compression required to engage the lugs fully in the bayonet grooves (and to disengage them, when desired) is almost the maximum possible with the given dimensions.

Figure 9:
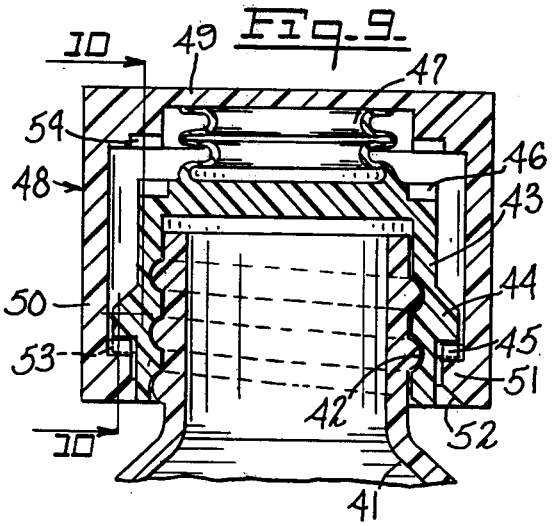
FIG. 9 represents a detail vertical section of a further modified form of container neck with double cap.
Figure 10:
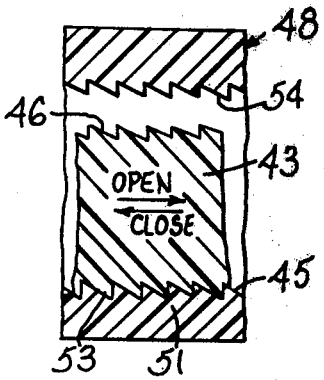
FIG. 10 represents a detail vertical section on the line 10—10 of FIG. 9.
Figure 11:
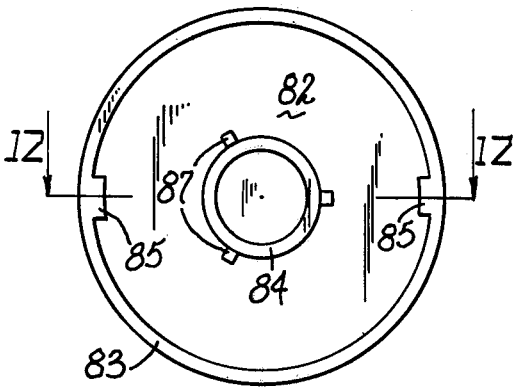
FIGS. 11 and 12 represent a bottom plan view and axial section on the line 12—12 of an aerosol can cap, for use in the can closure assembly of FIGS. 14-15.
Figure 12:
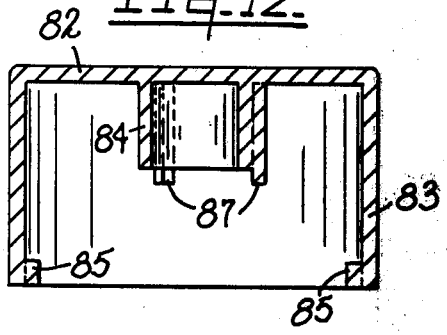

The closure system of FIGS. 9 and 10 is adapted for use on a bottle having an externally threaded neck of normal form, the bottle neck being 41 and the thread 42. An inner cap 43 is threaded to screw tightly onto the bottle neck and is provided with an annular shoulder 44 bearing a row of downwardly facing ratchet teeth 45 adjacent the lower edge of the cap and another row of upwardly facing ratchet teeth 46 around the upper edge. A convoluted plastic spring 47 is affixed to the top of the cap inwardly of the teeth 46 and projecting upwardly. The outer cap 48 has a top wall 49, cylindrical side wall 50 and an inwardly projecting flange 51 around the bottom of the side wall, the flange being beveled as shown at 52 and having a row of upwardly facing ratchet teeth 53 adapted to engage the teeth 45. The upper part of cap 48 has a row of downwardly facing ratchet teeth 54, in a position to engage with the teeth 46 on the inner cap. The caps are assembled with a snap fit, by forcing the beveled flange 52 downward past the shoulder 44.

The spring 47 has the characteristics of the springs described above and acts to push the outer cap upward, holding the teeth 53 in engagement with the teeth 45, these sets of teeth being angled so that clockwise rotation of the outer cap tends to tighten the inner cap on the bottle neck, whereas counter-clockwise rotation causes the teeth 53 to ride past the teeth 45 without unscrewing the inner cap. In order to open the bottle, the outer cap must be pressed down against the strong resistance of the spring 47 until the oppositely angled teeth 54 engage the teeth 46, when counter-clockwise rotation of the outer cap will turn the inner cap in the unscrewing direction.

Figure 13:
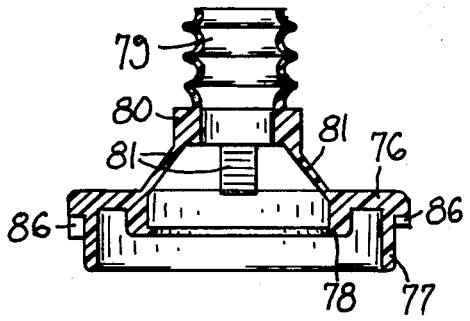
FIG. 13 represents a vertical axial section of the spring element to be applied to an aerosol can.
Figure 14:
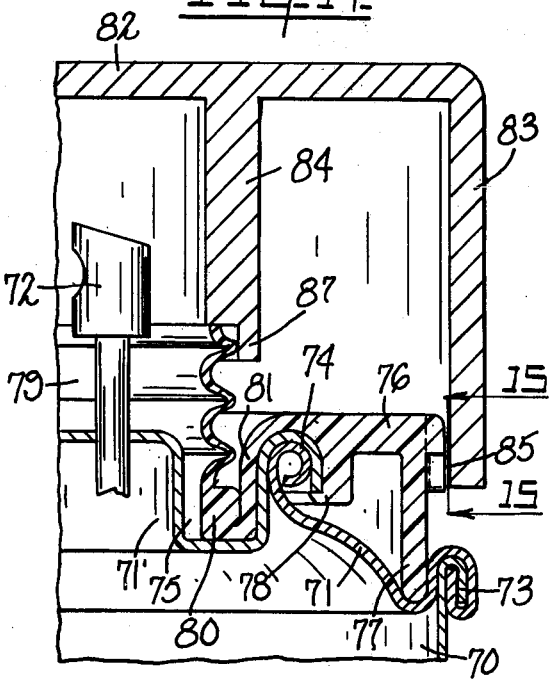
FIG. 14 represents a detail vertical section of an aerosol spray can top with the spring closure mounted thereon, parts being broken away.
Figure 15:
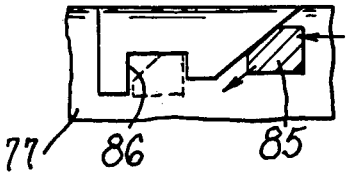
FIG. 15 represents a detail section on the line 15—15 of FIG. 14.

The plastic spring can be further adapted for inclusion in a safety closure for aerosol spray cans, as shown in FIGS. 11–15. Such a can comprises the body 70, a top 71, 71' and a spray nozzle 72. The top is shown as being formed of two concentric parts, the outer part 71 being connected to the upper edge of the body by a bead 73 and to the inner part by a bead 74, having a slight outward overhang. The inner part is annularly dished, around the nozzle, as shown at 75. The spring element of the closure includes an annular outer base 76, having a cylindrical flange 77 shaped to rest on the outer top 71 of the can inside the bead 73, and provided with an inwardly directed shoulder 78 sized to fit tightly under the overhanging bead 74, as shown in FIG. 14. The convoluted plastic spring 79 is cylindrical and integral with the inner base 80 which, in turn, is connected to the outer base 76 by a plurality (e.g., three or four) of radially disposed straps 81.

The spring element (FIG. 13) is affixed to the can top, as shown in FIG. 14, by snapping the shoulder 78 into position under the edge of the bead 74, and by then forcing the inner base into the annular depression 75, the position of the straps 81 being somewhat reversed as can be seen by comparing FIG. 14 with FIG. 13. The cap (FIGS. 11 and 12) has a top wall 82, outer cylindrical skirt 83 and an inner "spring compressor" 84, so proportioned that the spring must be forcibly compressed by downward movement of the cap in order to bring the lugs 85 on the lower edge of the skirt 83 into engagement with the latches 86 on the outer surface of the base 76 adjacent the upper edge of flange 77. The spring compressor 84 may be provided with guide fingers 87 to ensure proper engagement. To remove the cap, it is necessary to press it down forcibly against the upward bias of the spring 78 in order to disengage the lugs 85 from their respective latches 86, followed by relative rotation of the cap.

Figure 16:
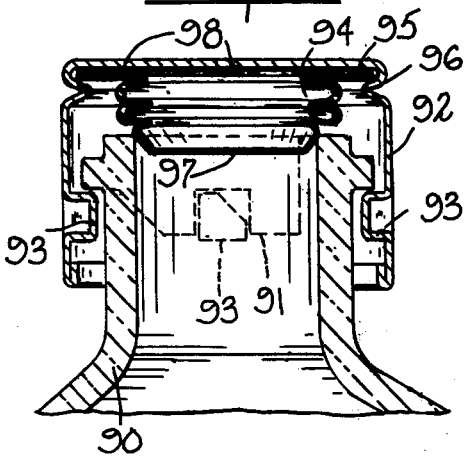
FIG. 16 represents a vertical section of a bottle neck with metal cap and plastic spring insert.
Figure 17:
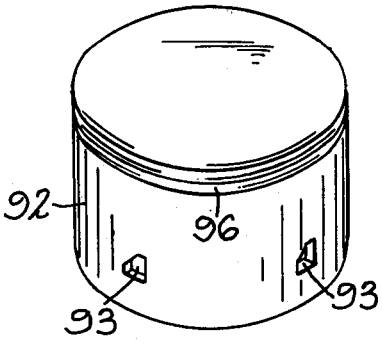
FIG. 17 represents a perspective view of the cap of FIG. 16.

FIGS. 16 and 17 show a glass bottle 90, the neck of which is provided with integral latches 91 (similar to latches 12 and 86), and the metal cap 92 is formed with inwardly projecting lugs or keys 93 adapted to be engaged with and disengaged from the latches. The plastic bellows-type spring 94 includes a relatively stiff flat annular mounting ring 95, designed to snap behind an inwardly projecting bead 96 adjacent the top of the metal cap, the spring having a closed bottom 97 with a beveled periphery engaging tightly against the lip of the bottle neck. The ring 95 has its upper surface traversed by one or more radial air grooves 98 to permit free expansion and contraction of the spring in response to pressure applied to the cap for engaging it or disengaging it, as will be understood.

Figure 18:
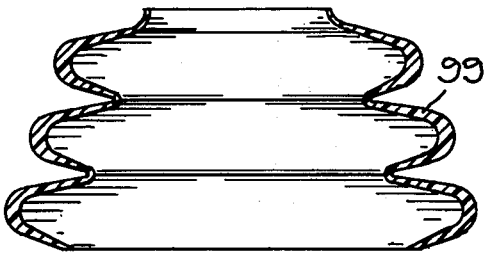
FIG. 18 represents an axial section of a modified form of spring.

While most of the springs described above have been cylindrical, it may be convenient, in some instances, to make them frusto-conical, an example being the spring 99, shown in FIG. 18.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

What is claimed is:

1. In a closure for containers wherein the application and removal of the closure require forcible axial movement of a closure element relative to the container top, a closure comprising an outer element adapted for manual manipulation and a spring element interposed between the outer element and a portion of the container in a position to resist axial movement of said outer element toward said container, the spring element being of a hollow body of resilient plastic material having convolutions along the length thereof, said element being hollow with at least one end unenclosed, said convolutions having inner and outer ridges, the inner ridges defined on first radii which determine the thickness thereof, the outer ridges defined on second radii, said thicknesses being of unequal dimension whereby the wall portions extending between said ridges are of tapering thickness whereby the radii and varying wall thickness determine the spring characteristics of said spring element, said spring being precompressed along said longitudinal axis to give it a permanent set of decreased axial dimension in an unloaded condition, the predominant preset of said spring occurring in the thinner walled ridges, said convolutions being of essentially annular shape perpendicular to the longitudinal axis, and cooperating means on said closure and container for latching said closure to said container against the bias of said spring, said cooperating means requiring further compression of said spring to unlatch said cooperating means.

2. The combination according to claim 1 wherein the radially outer wall portions of each convolution are thicker than the radially inner wall portions thereof.

3. The combination according to claim 1 wherein the spring is frusto-conical.

4. The combination of claim 1 wherein the convolutions are disposed helically.

5. The combination according to claim 1 wherein the spring element is integral with the container.

6. The combination according to claim 1 wherein the spring element is integral with the closure.

7. The combination according to claim 1 wherein the outer element is a metal cap and the spring element is mounted in said cap.

* * * * *